US005871323A

United States Patent [19]

Clark

[11] Patent Number: 5,871,323

[45] Date of Patent: Feb. 16, 1999

[54] BOOKBINDING

[75] Inventor: Anthony J. Clark, Monk's Risborough, United Kingdom

[73] Assignee: National Starch and Chemical Investment Holding Corporation, Wilmington, Del.

[21] Appl. No.: 455,942

[22] Filed: May 31, 1995

[51] Int. Cl.[6] ..... B42C 11/02

[52] U.S. Cl. ..... 412/4; 412/8; 412/19

[58] Field of Search ..... 412/8, 1, 11, 14, 412/19, 24, 18, 37

[56] References Cited

U.S. PATENT DOCUMENTS

| | | | |
|---|---|---|---|
| 1,543,378 | 6/1925 | Frazier et al. . | |
| 1,755,237 | 4/1930 | Bredenberg . | |
| 3,825,963 | 7/1974 | Abildgaard et al. | 11/1 R |
| 5,434,215 | 7/1995 | Sankaran et al. | 524/763 |

FOREIGN PATENT DOCUMENTS

| | | | |
|---|---|---|---|
| 0330156 | 8/1989 | European Pat. Off. | 412/14 |
| 0303893 | 12/1990 | Japan | 412/14 |
| A-1 266 681 | 6/1968 | United Kingdom . | |
| 2 084 928 | 4/1982 | United Kingdom | B42C 1/00 |
| 2 138 358 | 10/1984 | United Kingdom | B42D 1/06 |
| 2 149 351 | 6/1985 | United Kingdom | B42C 11/04 |

*Primary Examiner*—Willmon Fridie, Jr.
*Attorney, Agent, or Firm*—Ellen T. Dec

[57] ABSTRACT

The disclosure relates to an apparatus and method of bookbinding in which the clamp for the book block is braced at least while it is stationed at a cover applicator, whereby to permit the applicator to apply high forces to the book when positioning the cover. This in turn permits the use of pressure-unstable adhesives, such as adhesive emulsions, and leads to semi-finished books that are handleable and can be subjected to further processing immediately after formation.

10 Claims, 3 Drawing Sheets

BOOKBINDING

This invention relates to improvements in or relating to bookbinding. In particular, the invention relates to an apparatus for bookbinding using a water based adhesive; a method of bookbinding; a book made by use of the method of the present invention; and the use of a pressure-unstable adhesive material in bookbinding methods and apparatuses.

The great majority of books are presently manufactured using unsewn (so-called "perfect") binding methods. Unsewn binding methods permit the mass production of books in highly automated factories, and have numerous economical and practical advantages over traditional sewn binding methods, many of which involve or consist of steps carried out by hand.

The apparatuses in binderies where books are produced by unsewn binding methods take various forms and can be arranged in numerous ways. In a simple form of binding machine, described herein for purposes of illustration, the signatures that form the book block are initially collated at a collation station after drying of the printed matter, and inserted into an adjustable clamp that serves to support the book block during subsequent steps of the bookbinding process.

The clamp is tightenable about the book block so as temporarily to hold the signatures of the book block together. The spines of the respective signatures typically protrude downwardly below the lowermost edge of the clamp, which is moveable in the apparatus typically initially to a cutting station. The cutting station forms the spine of the book block by trimming the spines of the respective signatures in order to produce a flat spine edge. Details of several spine cutting units can be found e.g. in Bookbinding with Adhesives (Second Edition) by Tony Clark, published under ISBN 0-07-707985-X by McGraw-Hill Book Company Europe in 1994.

After cutting of the spine of the book block, the clamp is moved to an adhesive applicator (typically in the form of spinning rollers covered in adhesive) that applies adhesive to the spine formed in the book block.

Thereafter the clamp is moveable to a cover applicator that typically includes a channel slightly wider than the width of the spine of the book block. The channel is moveable relative to the book block so that it can surround the spine, and it will be appreciated that if a book cover is interposed between the channel and the spine the action of moving the channel towards the spine will cause the cover to be pushed onto the spine and simultaneously folded about the book block. The presence of adhesive material in the region of the spine causes the cover to become adhered to the book block in the vicinity of the spine.

Bookbinding machines can include numerous additional features, and of course it is common for a factory installation to include multiple clamps whereby many books are processed in the apparatus sequentially at high speed.

Various adhesive materials are employed in bookbinding apparatuses of the general kind outlined hereinabove. However, it is a characteristic of all such emulsion adhesives that they take a considerable time to cure or dry in order to form a firm enough bond to permit handling of a completed book.

The problem of long curing or drying times of adhesives known in the bookbinding art has been addressed in two ways. One is simply to allow a long run-out conveyor for completed books, on which the books travel during curing or drying of the adhesive material. This arrangement is commonly used when the adhesive is e.g. a hotmelt material, since the run-out conveyor is suitable for introducing a delay in the processing of the books that permits them to cool.

However, the long run-out conveyors are disadvantageous when used with cold adhesives partly because of the extra processing time that is added to the manufacturing of the books; and partly because the run-out conveyors take up space in the bindery.

An alternative is to use radio frequency or infrared driers on the books after they have left the cover applicator. Whilst the use of such driers speeds the drying of the adhesive materials, the costs of the driers are exceptionally high; and they can be expensive to operate in terms of electricity consumption.

Accordingly, there is a need for a bookbinding apparatus and method that permits the rapid, economical finishing of books to a state such that they can be handled.

According to the invention in its simplest form, there is provided the use of a pressure-unstable adhesive to adhere parts of a book together.

According to the invention in a second aspect there is provided a bookbinding apparatus including a support for one or more signatures; an adhesive applicator for applying adhesive material to at least one signature supported by the support and/or to a cover to be applied to the signature; and a cover applicator for applying a cover to a signature supported by the support by pressing the cover onto said signature such that the adhesive bonds the cover and the signature together, wherein the apparatus includes a brace acting on the support in opposition to force applied by the cover applicator, whereby to permit the use in the apparatus of an adhesive material that is pressure-unstable.

By a "pressure unstable" adhesive is meant an adhesive that remains e.g. in liquid form in a steady state until it is subjected to pressure, at which point curing or drying of the adhesive material commences. Use of such a material in apparatus according to the invention gives rise to books the spines of which are in a semi-solid state immediately after application of their covers. It has been found that books in this state are readily trimmed or cut, and can be stacked onto pallets or into packs for distribution. The books in this state can also undergo further processes such as shrink wrapping. Curing or drying of the adhesive material takes place over a period following application of the book cover.

Although in its simple form the invention is considered to reside in the use of a pressure-unstable adhesive material, for example but not not exclusively in the form of an emulsion, to adhere parts of a book together, it is not an essential prerequisite that such use occurs in apparatus as defined hereinabove. However it has been found that the pressures needed to cause instability of suitable pressure-unstable adhesives are higher than those normally used in known bookbinding machines. Consequently, when using pressure-unstable adhesives, it is desirable to employ apparatus according to the invention to permit the production of books on a commercial scale.

Preferably the adhesive applicator applies adhesive material to the spine of the signature; however this is not an essential prerequisite. For example, in the so-called "Otabind" process, a cloth or crepe paper is wrapped around the book block and secured with adhesive. The cover binding adhesive is only applied to the edges of the crepe paper or cloth adjacent to the spine, and not to the spine itself. For the avoidance of doubt, therefore, it is hereby stated that references herein to a "signature" apply equally to a book block, or indeed to a partly finished book block of the Otabind type in which an additional intermediate membrane is applied over the conventional book block before the cover is adhered thereto.

The term "book" as used herein includes magazines, brochures, pamphlets and indeed any artifact that can be manufactured by a process similar to or including so-called "perfect binding" processes.

The term "cover" as used herein includes linings, backstrappings or other substrates adhered to the sides (e.g. back and/or front) of the book.

Preferably, the support is a clamp-type support, in particular including an adjustable jaw. When the clamp includes an adjustable jaw, the position of the brace is adjustable to accommodate the adjustable jaw.

Conveniently the support is moveable on the apparatus between the adhesive applicator and the cover applicator, and the brace includes a channel member rigidly secured relative to the apparatus and a protuberance on the support, the protuberance being received in the channel member, to brace the support on moving of the support to or towards the cover applicator.

Alternatively, the clamp is a hinge-type clamp moveable between the adhesive applicator and the cover applicator and the brace includes a cam and follower one element of which is rigidly secured relative to the apparatus and the other element of which is secured on a hingeable jaw of the hinge-type clamp, the cam and follower being mutually engageable, so as to oppose force applied by the cover applicator, on moving of the clamp to or towards the cover applicator.

Conveniently the protuberance is secured to the adjustable jaw and the channel member is adjustably secured to the apparatus whereby to receive the protuberance regardless of the adjustment of the adjustable jaw.

The foregoing features advantageously permit the apparatus of the invention to be incorporated into conventional bookbinding machines.

In preferred embodiments that include the cam and follower arrangement referred to hereinabove, one of the cam and follower secured relative to the apparatus is shaped and/or dimensioned for engagement with the other of the cam and follower over a range of adjustments of the hingeable jaw. Thus, when the apparatus is incorporated into a bookbinding machine having a hinge-type clamp, there is no need for specific adjustment of the cam and follower since this automatically occurs on adjustment of the hingeable jaw.

According to a third aspect of the invention, there is provided a method of bookbinding comprising the steps of:

supporting at least one signature by means of a support;

applying adhesive material to at least one signature supported by the support and/or to a cover to be secured to the signature;

applying the cover to at least one signature or book block, supported by the support, by pressing said cover onto said signature such that the adhesive bonds the cover and the signature together; and bracing the support, during the step of applying the cover, against force applied during pressing of the cover onto the support, whereby to permit use of an adhesive material that is pressure-unstable.

This method advantageously permits the formation of a book that is handleable immediately after application of the cover thereto, even though the pressure-unstable adhesive material may not be fully cured or dried.

Preferably, but not essentially, the adhesive material is applied to the spine of the signature. When the adhesive is applied to the spine, the pressure provided during application of the cover forces adhesive material into the material of the spine, thereby creating the handleable book referred to previously.

In particularly preferred embodiments, the method of the invention is carried out in apparatus according to the invention.

Preferably the support is moveable relative to the remainder of the apparatus and the step of bracing the support includes the sub-step of causing, during movement of the support on the apparatus, a first member secured to the support to engage a further member fixed relative to the remainder apparatus so as to oppose force acting on the support during the step of applying a cover. It is also preferable that the first and further members are receivable within one another; additionally or alternatively the first and further members include a cam and follower pair.

These features advantageously permit the method to be carried out in apparatus according to the invention, which may in its turn be modified bookbinding apparatus that otherwise is of a conventional kind.

Conveniently the support is moveable between an adhesive applicator and a cover applicator and the step of bracing the support occurs at least when the support is positioned at the cover applicator.

The invention is also considered to reside in a book bound by a method as aforesaid; in a book in particular but not exclusively as aforesaid bound by a pressure unstable adhesive material, and in the use of a pressure-unstable emulsion to adhere paper stock of a book.

The adhesive that may be used in the process of the present invention is preferably based on a emulsion that is unstable under pressure. In this regard, the emulsion can be stable during storage but when exposed to the pressure of the bookbinding process of the present invention it becomes unstable in that it quickly sets. Alternatively, the emulsion can be made unstable just prior to the coating process by, for example, adapting a more stable emulsion. This may be achieved by adding for example chemicals such as borax.

An advantage of using an unstable adhesive is that, unlike existing processes of drying etc., there is minimal water loss from the paper stock of the book, and furthermore, water from the emulsion when it is made unstable flows into the paper stock.

A further advantage is that there are minimal odour problems associated with the emulsions that are pressure unstable, unlike the conventional adhesives used before.

Therefore, in a highly preferred embodiment the adhesive used for coating the paper stock is unstable under pressure.

Emulsions for use as the adhesive (also referred to as an adhesive material) in the process of the present invention can be PVA based emulsions and/or emulsions prepared by polymerising methacrylic acid or acrylic acid or derivatives thereof. The emulsions can contain typical additives such as activates, catalysts, tackifiers, accelerators, stabilisers, emulsifiers, surfactants, rheology modifiers, etc.

The adhesive for use with the bookbinding apparatus according to the present invention may preferably comprise any one or more of the following: polyvinyl alcohol stabilised vinyl acetate homopolymer or copolymer admixed with a suitable crosslinker, e.g. boric acid, that causes the vinyl acetate to be pressure unstable; a polyurethane at a pH of less than 7, i.e. outside its optimum pH range and consequently pressure-unstable; natural rubber latex; or any other suitable polymer emulsion having a limited stabilisation under pressure such as by minimal use of a suitable colloid, surfactant or emulsifier.

The invention is believed to be successful because the use of a brace permits the use of sufficiently high pressures at the cover station to cause the pressure unstable adhesive to commence its drying/curing phase, without damaging the book block clamp or forcing it off its track.

There now follows a description of preferred embodiments of the invention, by way of example, with reference being made to the accompanying drawings in which.

Figure 1:
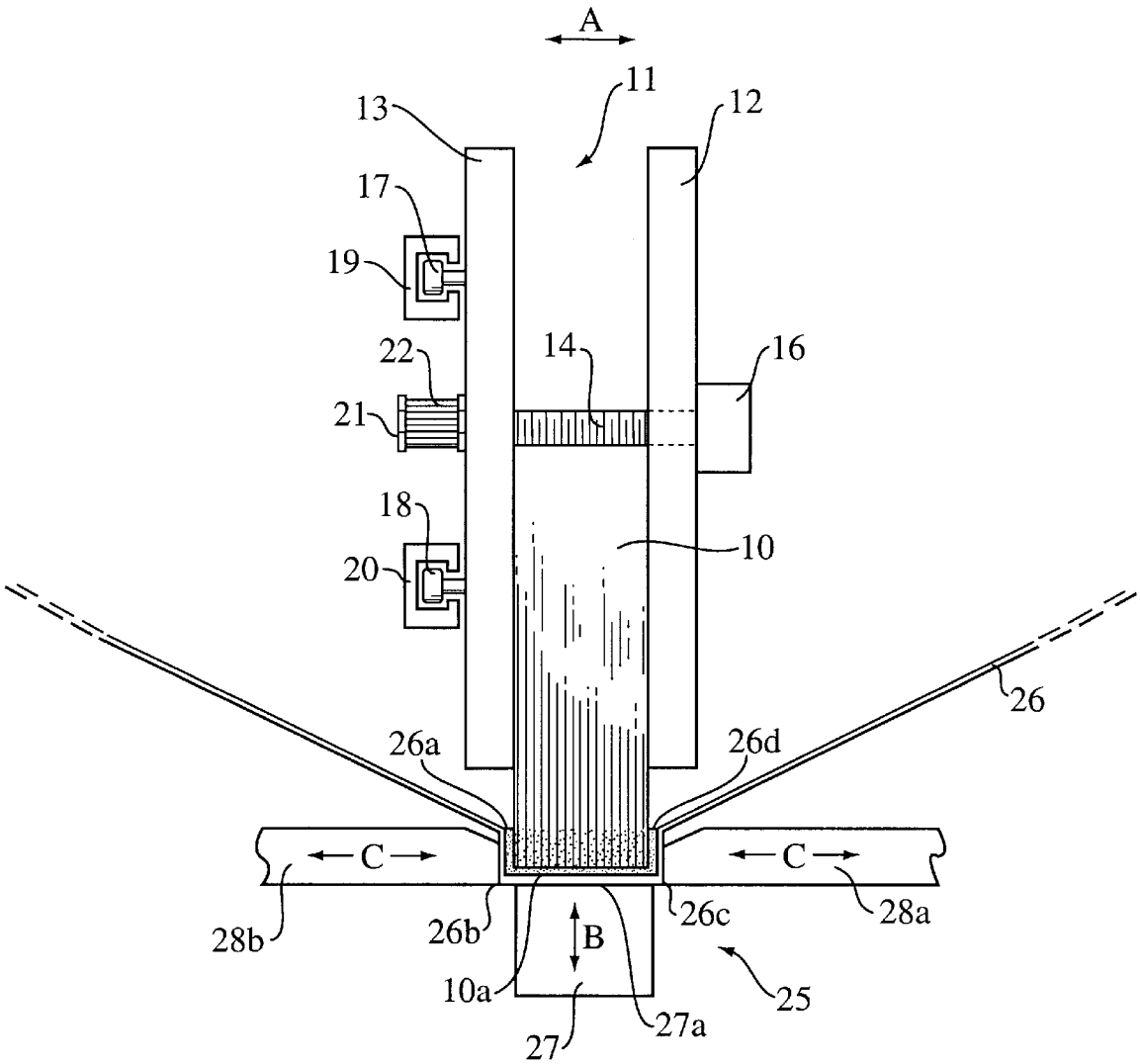
FIG. 1 PRIOR ART
FIG. 1 is an end elevational view of the cover station of a prior art bookbinding machine.

Referring to the drawings there is shown firstly a cover station, at which book covers are applied to book blocks 10, of a prior art bookbinding machine.

The bookbinding machine includes an adjustable clamp 11 having front and rear jaws 12, 13. The jaws 12, 13 are tightenable about a book block 10 that has been collated and spine-trimmed, by means of tightening screws such as screw 14 interconnecting the front and rear jaws 12, 13. As is shown in FIG. 1, the tightening screws 14 lie above the uppermost edge of the book block when clamped in the clamp 11, and the spine 10*a* of the book block protrudes downwardly below the lowermost edges of the jaws 12, 13.

The screws such as screw 14 are tightened and loosened by virtue of a tightening mechanism represented schematically in FIG. 1 by block 16.

Rear jaw 13 is fixed in the direction of arrow A, whereas front jaw 12 is adjustable in the direction of arrow A whereby to accommodate book blocks 10 of various thicknesses.

Adjustment of the position of front jaw 12 is achieved by means of a screw 14 operable via a screw actuator indicated schematically by reference numeral 16, whereby jaw 12 may be driven selectively towards and away from jaw 13.

Jaw 13 includes, secured to its rear face, upper and lower bearing units 17 and 18. Each bearing 17, 18 is loosely captive in a respective guide channel or track 19, 20, such that jaw 13 is moveable longitudinally in the bookbinding apparatus, in a generally horizontal direction perpendicular to arrow A. The bearings 17, 18 permit the clamp 11 to be moved horizontally through the apparatus e.g. from the collation station via the spine cutter and the adhesive applicator to the cover station shown in FIG. 1.

The rear face of jaw 13 also include an attachment point 21 for a drive chain 22. Chain 22 is drivingly secured to the output shaft of a motor, whereby jaw 13 may be driven along the bookbinding apparatus between the various operative stations thereof.

Since jaw 12 is adjustably secured to jaw 13 by means of screw 14, movement of jaw 13 causes movement of the clamp 11 as a whole. If jaw 12 is tightened onto a book block 10, movement of clamp 11 also causes movement of the book block 10 from station to station in the bookbinding apparatus.

The lower part of the apparatus shown in FIG. 1 is constituted by a cover applicator indicated generally by reference numeral 25. Cover applicator 25 is intended to apply a cover such as cover 26 to the spine of book block 10 in a known manner.

Cover applicator 25 includes a cover breaker unit 27 and a side nip unit comprising side presses 28*a* and 28*b*.

The side nip unit constituted by presses 28*a*, 28*b* effectively forms a channel that is initially slightly wider than the width in the direction of arrow A of the book block 10. The cover breaker unit comprises a press face 27*a* that is moveable vertically in the direction of arrow B towards and away from the lowermost edge of spine 10*a*. It will be appreciated that if a book cover 26 is interposed between the elements of the cover applicator 25 and the spine 10*a*, raising of the cover breaker 27 will cause the cover 26 to be folded about the lowermost end of spine 10*a*, in approximately a U-shape.

The side nip presses 28*a*, 28*b* are moveable horizontally in the direction of arrows C. Movement of the side nip presses 28*a*, 28*b* towards the spine 10*a* after upward movement of the cover breaker to push the cover onto the spine and form it into a U-shape causes the cover to adopt the shape shown in FIG. 1, with sharp creases or folds at points 26*a*, 26*b*, 26*c* and 26*d*.

The nose of each side nip press 28*a*, 28*b* that presses into the spine region 10*a* is chamfered on its upper edge in order to assist in producing a conventional cover shape. The forwardmost edge of each side nip press 28*a*, 28*b* can additionally include projections or other features of shape in order e.g. to add grooves, depressions and other features to the cover 26. Similarly, the upper face 27*a* of cover breaker unit 27 can be similarly provided with projections and other features of shape in order to provide decorative and other effects on the spine of the book.

The cover 26 is adhered to the spine 10*a* by virtue of adhesive material that is interposed between the cover 26 and the spine 10*a*. The adhesive material is applied at an adhesive applicator over which the spine 10*a* is passed in the clamp 11 after trimming of the spine in a spine cutter. However, it is equally possible that adhesive material be applied to the cover 26, or that adhesive material is applied to both spine 10*a* and to cover 26 prior to pressing of the cover 26 onto the spine 10*a*.

Since the clamp 11 is supported in cantilever fashion by virtue of the bearings 17, 18, the maximum forces that can safely be applied by the cover applicator are limited. If excessive forces are applied, the clamp 11 either becomes distorted or becomes pushed off its tracks 19, 20 with the result that book production is interrupted and books are wasted. Accordingly, the cover applicator 25 is adjusted to apply only very light forces, and the adhesive materials are chosen such that adhesion between the cover and the book is achieved as a result of setting, curing or drying of the adhesive material over a lengthy period after application of the cover 26. As a result, the books formed at the cover station shown in FIG. 1 are not robust until a considerable period has elapsed after their formation. Consequently, in the apparatus of FIG. 1 it is not possible to perform further processing steps on the books until a considerable period of time has elapsed, unless the radio frequency and infrared devices referred to hereinabove are employed.

Figure 2:
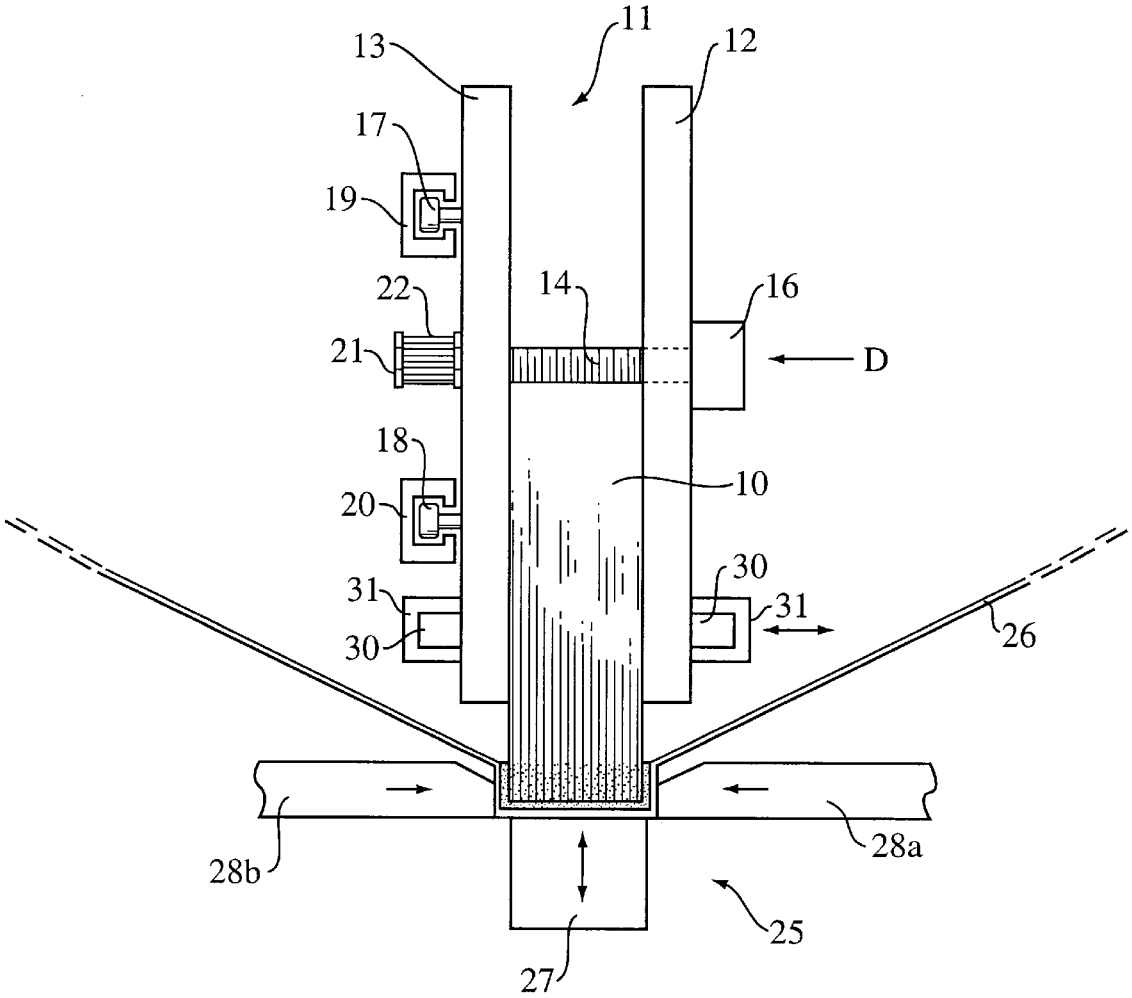
FIG. 2 is an end elevational view of the cover station of a bookbinding machine according to the invention.

Referring now to FIG. 2, there is shown a cover station in a bookbinding apparatus according to the invention. The apparatus of FIG. 2 is the same as that shown in FIG. 1, except for the provision of a brace constituted by respective bar and slot pairs 30, 31 applied respectively to the front and rear jaws 12, 13 of the clamp 11.

Figure 3:
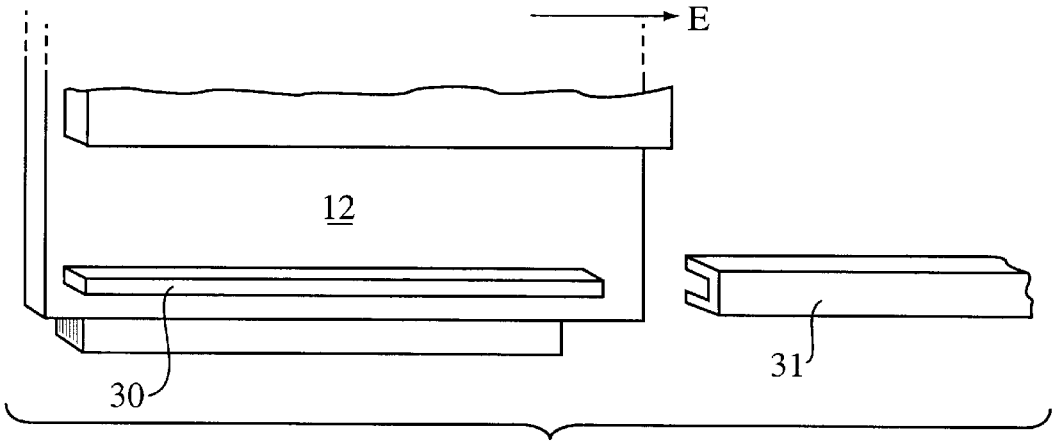
FIG. 3 is a perspective view from one side of the apparatus of FIG. 2.

As best shown in FIG. 3, which is a perspective view of the FIG. 2 apparatus taken in the direction of arrow D, each bar and slot pair comprises an elongate bar 30 extending generally horizontally along the lower part of front clamp 12 such that bar 30 protrudes therefrom.

Slot 31 is fixed relative to the remainder of the bookbinding apparatus, e.g. by virtue of being secured to the chassis of the apparatus.

The clamp 11 is moved in the direction of arrow E in order to bring the book block 10 into position at the cover applicator 25, and the shapes and relative positions of bar 30 and slot 31 are such that on such movement bar 30 is slidingly received in elongate channel member 31 in the manner shown in FIG. 2.

The bar and slot arrangement 30, 31 applied to the rear jaw 13 of clamp 11 is a mirror image of that applied to jaw 12, and it will thus be seen that once the clamp 11 is brought into position at the cover applicator 25, the respective bar and slot pairs 30, 31 serve to brace the clamp 11 against any forces that may be applied thereto. This bracing of clamp 11 obviates any need for the bearings 17, 18 to counteract any forces applied to the clamp 11 while it is at the cover applicator 25.

Consequently, the forces applied by the cover breaker unit 27 and the side nip units 28 can be significantly greater in the apparatus of FIG. 2 than in the apparatus of FIG. 1. This in turn means that the adhesive material to be used can be a pressure-unstable material, that commences to set, dry or cure as soon as it is subjected to a predetermined minimum pressure such as may be applied by the cover applicator 25 of the apparatus of FIG. 2.

The action of applying higher pressures than hitherto at the applicator 25 permits the forcing of adhesive material between the pages exposed at the spine 10*a* of the book block 10. This results in the formation of a semi-solid spine region that has been found to withstand numerous further processing steps immediately after it has been formed. This is true even though the pressure-unstable adhesive may be of a type that does not set, dry or cure fully until some time has elapsed after the cover application steps.

Figure 5:
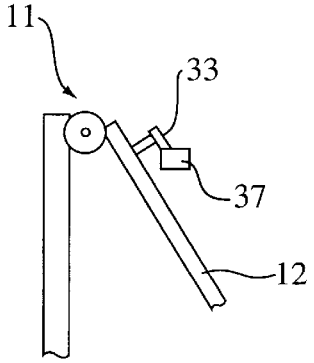
FIG. 5 is a schematic view of parts of the apparatus of FIG. 4 showing the clamp in its open position.
Figure 6:
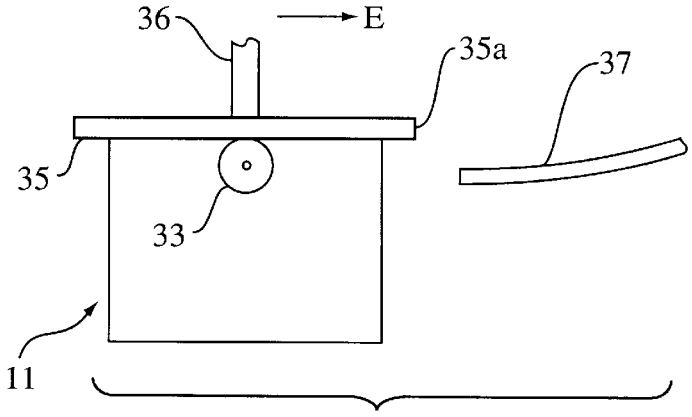
FIG. 6 is a side elevational view showing components for automatically opening the clamp shown in FIGS. 4 and 5.

The braces constituted by the bar and slot pairs 30, 31 may take numerous forms. An alternative is shown in FIGS. 4 to 6.

Figure 4:
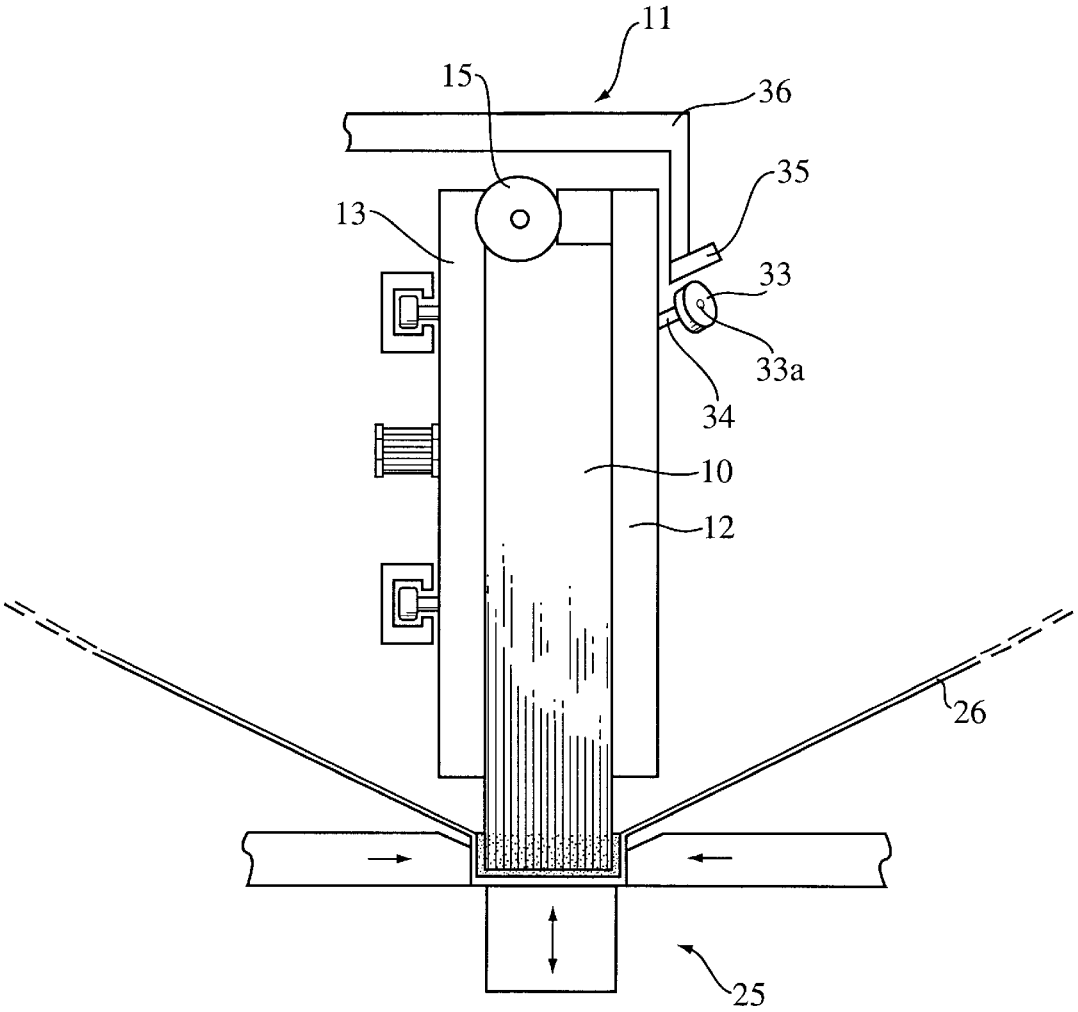
FIG. 4 is an end elevational view of the cover station of an alternative embodiment of the invention.

In the embodiment of FIG. 4, the clamp 11 is of the so-called hinge type. In this type of clamp, the front jaw 12 is hingeably secured to the rear jaw 13 by means of a suitable hinge 15. FIG. 5 shows the clamp 11 in its open-hinged state, with the front jaw 12 inclined to the vertical. FIG. 4 shows the clamp 11 in its closed state, with the front and rear jaws 12, 13 generally parallel to one another and a book block 10 tightly secured therebetween.

The exposed face of front jaw 12 includes secured thereto a cam follower in the form of roller 33. Roller 33 is secured by means of a mounting 34 to jaw 12, such that roller 33 is rotatable about a horizontal axis 33*a* passing through its centre.

A downwardly directed cam surface 35 is secured to the apparatus by a mounting member indicated schematically by reference numeral 36. Cam surface 35 is positioned and dimensioned such that, on moving of clamp 11 in the direction of arrow E (FIG. 6) the roller 33 engages surface 35. This action serves the dual purposes of closing the clamp 11 tightly about the book block 10, and simultaneously bracing the clamp 11 against forces applied by the cover applicator 25. Thus, it is possible to employ pressure-unstable adhesive materials in the embodiment of FIG. 4 to produce similar advantages to those arising from the use of the FIG. 2 apparatus.

As is shown in FIG. 6, the roller 33 can also be employed to open the clamp 11 after application of a cover 26 to the book block 10. This is achieved by further movement of the clamp 11 in the direction of arrow E, such that roller 33 clears the free end 35*a* of cam surface 35. Subsequently, on continued movement of clamp 11 in the direction of arrow E, roller 33 is engaged from beneath by a further cam surface 37 that is formed as an upwardly directed ramp. This action tends to drive roller 33 upwardly relative to jaw 13, with the result that jaw 12 opens to its position shown in FIG. 5. The completed book block is then removable e.g. by virtue of falling via a chute into a collection area or bin, and the clamp 11 may be returned to the front end of the bookbinding machine for receipt of a further signature or bundle of signatures for forming into a book.

When the clamp 11 occupies the position shown in FIG. 4, the bracing of clamp 11 acts on one side only of the clamp, i.e. that of jaw 12. However, it has been found that such bracing is sufficient to allow the application of forces at the cover applicator suitable for pressure-unstable adhesives such as those referred to previously. It follows from this that it is not essential in the embodiment of FIG. 2 for there to be a bar and slot arrangement associated with each of the two jaws 12, 13 of clamp 11. It may be sufficient for such a bar and slot arrangement to be applied to one side only of the clamp 11 in the FIG. 2 arrangement.

It will be appreciated that the invention is considered to reside in any means permitting bracing of the clamp 11 (or equivalent apparatus in a bookbinding machine) such that the forces applied by the cover applicator 25 can be increased to permit the use of pressure-unstable adhesives. Thus it is conceivable, for example, that the brace applies only a horizontal force e.g. at the base of one or other of the jaws 12, 13, whereby to counteract the turning moment resulting from the cantilever mounting of the clamp 11 and the application of force at a location spaced laterally from the axis of support of the clamp 11.

Although in FIG. 3 the bar and slot are shown as elongate items, it is not essential for this to be so. Indeed, in some embodiments it may be desirable for bracing of the clamp 11 to occur over only a very short part of its travel in the vicinity of the applicator 25.

There now follows a description of two examples of use of the process of the invention:

EXAMPLE 1

Book tests were run on a Sulby special binder employing a two wheel application unit for the adhesive material; and a standard spine cutting unit with a sanding disc. An adhesive material of the kind described herein as being suitable for use in the process of the invention, and hence of known instability under pressure, was used to bind the sample books.

Standard pocket book texts with 200 gsm covers were bound. After the adhesive application, the spine plate rise and side nip were increased until the machine almost stopped in the absence of the brace(s) of the invention. The result was a very firm spine that was trimmable within one minute on a standard guillotine.

EXAMPLE 2

This test was run in the same way as Example 1, but this time the body stock was a matt 90 gsm cartridge with a soft lining material. The spine was very firm and again trimmable within one minute.

Both tests exhibited an acceptable degree of repeatability.

I claim:

1. A bookbinding apparatus including a clamp-type support for one or more signatures; and adhesive applicator for applying adhesive material to the spine of at least one signature supported by the support and/or to a cover to be applied to a signature; and a cover applicator for applying a cover to a signature supported by the support by pressing the cover onto said signature such that the adhesive bonds the cover and the signature together, wherein the apparatus includes a brace acting on the support in opposition to force applied by the cover applicator, whereby to permit the use in the apparatus of an adhesive material that is pressure-unstable and wherein the clamp-type support includes an adjustable jaw, with the position of the brace adjustable to accommodate said adjustable jaw.

2. A bookbinding apparatus according to claim 1 wherein the support is moveable on the apparatus between the adhesive applicator and the cover applicator, and the brace includes a channel member rigidly secured relative to the apparatus and a protuberance on the support, the protuberance being received in the channel member, to brace the support, on moving of the support to or towards the cover applicator.

3. A bookbinding apparatus to claim 1 wherein the clamp is a hinge-type clamp moveable between the adhesive applicator and the cover applicator and the brace includes a cam and follower one element of which is rigidly secured relative to the apparatus and the other element of which is secured on a hingeable jaw of the hinge-type clamp, the cam and the follower being mutually engageable, so as to oppose force applied by the cover applicator, on moving of the clamp to or towards the cover applicator.

4. A bookbinding apparatus according to claim 1 wherein the protuberance is secured to the adjustable jaw and the channel member is adjustably secured to the apparatus whereby to receive the protuberance regardless of the adjustment of the adjustable jaw.

5. A bookbinding apparatus according to claim 1 wherein one of the cam and the follower secured relative to the apparatus is shaped and/or dimensioned for engagement with the other of the cam and the follower over a range of adjustments of the hingeable jaw.

6. A bookbinding apparatus according to claim 3 including a further cam or follower adapted to engage the cam or follower secured on the hingeable jaw on movement of the support to or towards a further location, whereby to open the hingeable jaw.

7. A method of bookbinding comprising the steps of:

supporting at least one signature by means of a support;

applying adhesive material to at least one spine of a signature supported by the support and/or to the cover to be secured to the signature;

applying the cover to at least one signature or book block, supported by the support, by pressing said cover onto said signature such that the adhesive bonds the cover and the signature together; and bracing the support, during the step of applying the cover, against force applied during pressing of the cover onto the support, whereby to permit use in the apparatus of an adhesive material that is pressure-unstable;

wherein the support is moveable relative to the remainder of the apparatus and the step of bracing the support includes the sub-step of causing, during movement of the support on the apparatus, a first member secured to the support to engage a further member fixed relative to the remainder apparatus so as to oppose force acting on the support during the step of applying a cover.

8. A method according to claim 7 wherein the first and further members are receivable one within the other.

9. A method according to claim 7 wherein the first and further members include a cam and follower pair.

10. A method according to claim 7 wherein the support is moveable between an adhesive applicator and a cover applicator and the step of bracing the support occurs at least when the support is positioned at the cover applicator.

* * * * *